US007427274B2

(12) United States Patent
Harris, Jr. et al.

(10) Patent No.: US 7,427,274 B2
(45) Date of Patent: Sep. 23, 2008

(54) METHOD AND APPARATUS FOR PROVIDING A MODIFIABLE MASSAGER

(75) Inventors: Kenneth David Harris, Jr., Hollis, NH (US); Charles J. Burout, III, Bedford, NH (US); James C. TerMeer, Concord, NH (US); Stephen B. Mills, Atkinson, NH (US); J. Neil Gleason, Milford, NH (US); Laura G. Warnock, Manchester, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 243 days.

(21) Appl. No.: 10/844,944

(22) Filed: May 13, 2004

(65) Prior Publication Data

US 2005/0256432 A1 Nov. 17, 2005

(51) Int. Cl.
*A61H 1/00* (2006.01)
*A61H 7/00* (2006.01)
*A61H 23/02* (2006.01)

(52) U.S. Cl. ..... 601/15; 601/18; 601/22; 601/49; 601/70; 601/87; 601/DIG. 1; 601/DIG. 17; 601/DIG. 20

(58) Field of Classification Search ..... 601/15, 601/18, 22, 27, 31, 32, 85–87, 90, 107, 108, 601/110, 111, 112, 113
See application file for complete search history.

(56) References Cited

U.S. PATENT DOCUMENTS 2,934,062 A 4/1960 Klassen et al.
3,830,232 A 8/1974 McNair
4,022,195 A * 5/1977 Meyer et al. ..... 601/18
D269,636 S 7/1983 MacGregor et al.
4,513,735 A 4/1985 Friedson et al.
D280,934 S 10/1985 MacGregor
4,722,326 A 2/1988 Ruderian
4,730,605 A 3/1988 Noble et al.
D299,863 S 2/1989 Noble et al.
4,936,292 A 6/1990 Hidetsugu
5,167,225 A 12/1992 Cheng-I
D367,931 S 3/1996 Shimizu
5,501,682 A 3/1996 Edwards-Cofie
5,573,500 A 11/1996 Katsunuma et al.
5,681,266 A 10/1997 Lin
5,685,827 A * 11/1997 Shimizu ..... 601/87
5,716,332 A 2/1998 Noble
5,728,051 A 3/1998 Chi
5,772,615 A 6/1998 Elder et al.
5,785,668 A 7/1998 Shimizu
5,797,859 A 8/1998 Prehodka
5,827,205 A 10/1998 Iwamoto
5,868,688 A 2/1999 Avidor et al.

(Continued)

*Primary Examiner*—Justine R. Yu
*Assistant Examiner*—Clinton Ostrup
(74) *Attorney, Agent, or Firm*—Grossman Tucker Perreault & Pfleger

(57) ABSTRACT

A massage base having a top surface contains at least one massage node base wherein the massage node base is motile in relation to the massage base. At least one massage node is mounted on each of the massage node bases and at least partially protrudes from the top surface. The massage node is mounted for rote movement in relation to the massage base. A motor, connected to the massage node base, engages the massage node in rote movement in relation to the massage base.

16 Claims, 6 Drawing Sheets

U.S. PATENT DOCUMENTS

| | | | | |
|---|---|---|---|---|
| D415,838 | S | 10/1999 | Noble | |
| D420,450 | S | 2/2000 | Anthony et al. | |
| 6,077,238 | A | 6/2000 | Chung | |
| 6,083,180 | A | 7/2000 | Shimizu | |
| 6,149,611 | A | 11/2000 | Chen | |
| 6,165,145 | A | 12/2000 | Noble | |
| 6,183,429 | B1 * | 2/2001 | Dervieux | 601/87 |
| 6,432,072 | B1 | 8/2002 | Harris et al. | |
| 6,494,849 | B2 | 12/2002 | Kuo | |
| 6,500,135 | B2 | 12/2002 | Huang | |
| 6,602,212 | B1 | 8/2003 | Ahn | |
| 6,730,050 | B2 | 5/2004 | Huang | |
| 6,733,406 | B2 | 5/2004 | Kitai et al. | |
| 6,786,878 | B2 | 9/2004 | Dehli | |
| 6,837,861 | B2 | 1/2005 | Lin | |
| 7,322,946 | B2 * | 1/2008 | Lev et al. | 601/15 |
| 2001/0027280 | A1 | 10/2001 | Huang | |
| 2002/0161315 | A1 | 10/2002 | Harris et al. | |
| 2002/0169400 | A1 | 11/2002 | Huang | |
| 2002/0193712 | A1 | 12/2002 | Huang | |
| 2003/0028134 | A1 | 2/2003 | Lev et al. | |
| 2003/0199796 | A1 * | 10/2003 | Yamazaki et al. | 601/87 |
| 2004/0176710 | A1 | 9/2004 | Kennedy et al. | |
| 2005/0010141 | A1 | 1/2005 | Mordechai et al. | |
| 2005/0020947 | A1 | 1/2005 | Dehli | |

* cited by examiner

METHOD AND APPARATUS FOR PROVIDING A MODIFIABLE MASSAGER

TECHNICAL FIELD

The present invention is generally related to electronic devices and, more particularly, is related to an apparatus and method for massaging body parts.

BACKGROUND OF THE INVENTION

It is well known that the artery, capillary, and peripheral nerves are concentrated in the foot soles of the human body. If a leg is fatigued, the circulation of the blood to the foot and through the capillary becomes sluggish, causing the compression of the peripheral nerves. Recovery from this fatigue in the feet and legs is thus delayed. The peripheral nerves of the foot sole are connected with the brain through the automatic nervous system, which controls the speed of physicals systems (e.g. blood flow) within the body. Stimulation of the foot sole causes the brain and autonomic nervous system to activate, after which increased blood flow through the legs and feet can be expected.

In folk medicine, a semicircular-shaped tool on which a foot is mounted is used to dissipate the fatigue in feet and legs. In oriental medicine, massage and acupuncture are used to stimulate an acupoint at which the peripheral nerve is concentrated. Recently, various types of electronic massage devices have been created for promoting circulation of blood in the feet.

Certain electronic massage devices deliver heat to the soles of the feet. While heat aids muscle relaxation, the soles of the feet are thicker and less sensitive to heat as compared to most areas of the body. As a result, heat is often ineffective and wasted. Ideally, an electronic massage device would be capable of delivering heat to the feet without having to penetrate the thick soles of the feet.

Also, many devices have been created that can massage the feet by vibration, heat, or by rotating massage heads. However, individuals can prefer different techniques on different occasions and no device has been created that can massage the feet using all three techniques. Ideally, an electronic massage device would be capable of massaging feet through vibration, heat, and rotating or kneading massage heads.

Massagers having rotating massage heads have a further drawback. Typically, massage heads rotate on a predefined area of the foot, based on the location of the rotating heads on the device in relation to how the massage device is designed to receive the foot. The individual using the massage device is forced to accept the massage provided to the specific area of the foot aligned with the rotating heads.

Foot massagers that have a predetermined orientation can also be difficult to use comfortably. As an example, certain floor-mounted foot massagers have a top surface angled between 5 and 20 degrees, as it has been found that some people are more comfortable resting their feet on an angular surface. These massagers are designed for people to put their feet in a comfortable position, with the massager oriented such that heels of a person are on a lower part of the top surface of the foot massager and their toes are on a higher part of the top surface. On such a massager, locations of massaging elements on the massager are permanently located, thereby limiting locations on the feet that can be massaged. Unfortunately, someone using the massager that wishes to knead different parts of their feet, is forced to shift their feet into uncomfortable positions or shift the massager and leave their feet in less comfortable positions.

Thus, a heretofore unaddressed need exists in the industry to address the aforementioned deficiencies and inadequacies.

SUMMARY OF THE INVENTION

Embodiments of the present invention provide an apparatus and method for providing a modifiable foot massager.

Briefly described, in architecture, one embodiment of the system, among others, can be implemented as follows. A base having a top surface contains at least one massage node base wherein the massage node base is motile in relation to the base. At least one massage node is mounted on each of the massage node bases and at least partially protrudes from the top surface. The massage node is mounted for rote movement in relation to the base. A motor, connected to the massage node base, engages the massage node in rote movement in relation to the base.

The present invention can also be viewed as providing methods for modifying a modifiable foot massager. In this regard, one embodiment of such a method, among others, can be broadly summarized by the following steps: having a base with a top surface, at least one massage node base in the unit, at least one massage node mounted on each of the massage node bases and at least partially protruding from the top surface, wherein the massage node is mounted for rote movement in relation to the base, and a motor connected to the massage node base. The last step is shifting the massage node base, within and in relation to the base, to another location in the base.

The present invention can also be viewed as providing a system for a modifiable foot massager. The system for the modifiable foot massager includes a means for kneading located within a unit for massaging a body part and a means for relocating for relocating the kneading means within the unit.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a massage device 10 capable of massaging feet of a user. While the present invention provides for the massaging device 10 being used for massaging feet, one having ordinary skill in the art will appreciate that the present massage device 10 may be used for massaging parts of the body other than feet.

Figure 1:
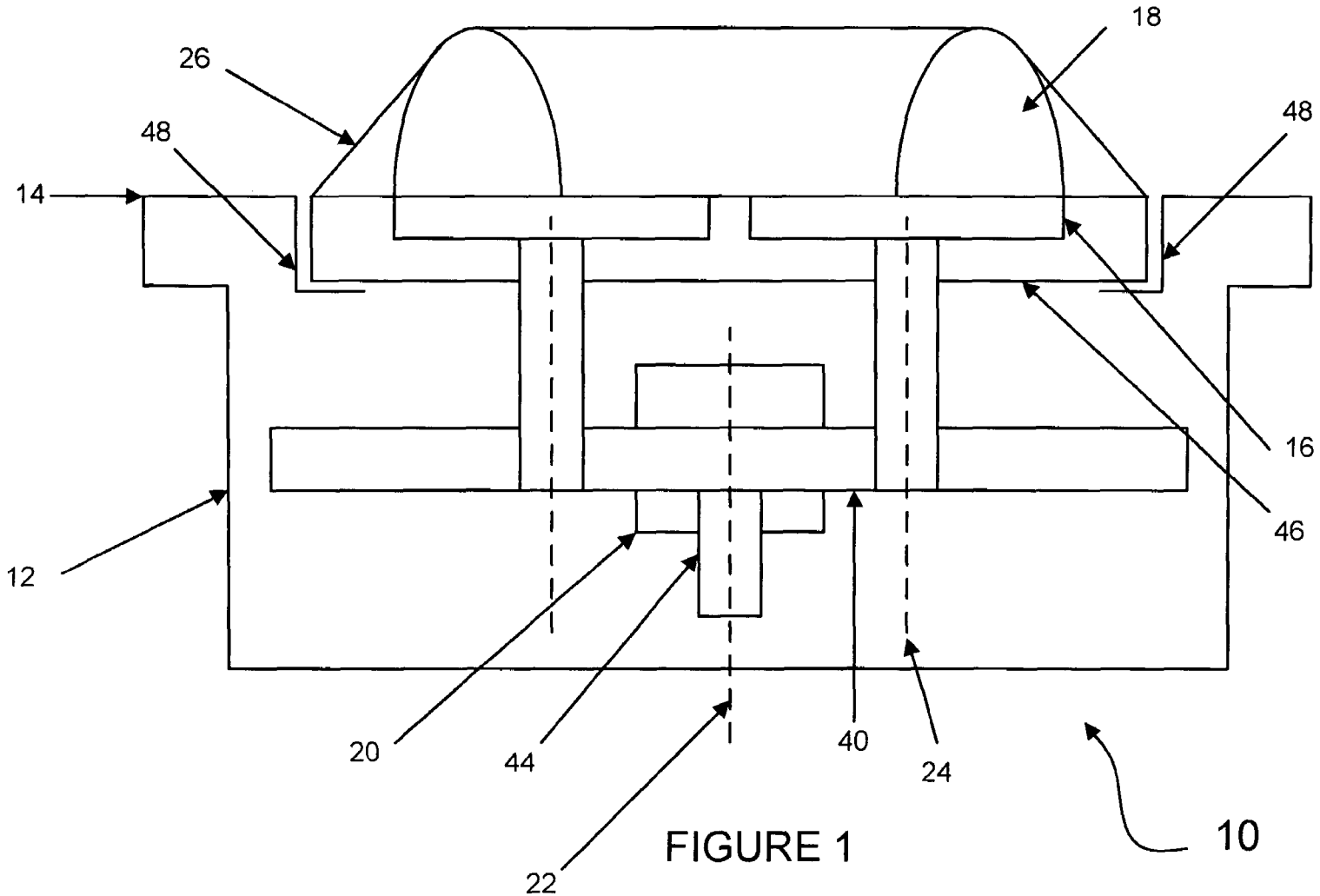
FIG. 1 is a cross-sectional side view of the first exemplary embodiment of the massager.

FIG. 1 is a top view of the massage device 10, in accordance with a first exemplary embodiment of the invention. The massage device 10 includes a massage base 12 having a top surface 14. The massage base 12 contains at least one massage node base 16, wherein the massage node base 16 is motile in relation to the massage base 12. Specifically, the position of the massage node base 16 may be shifted along a track, such as a rotational track 48, provided within the massage base 12. At least one massage node 18 is mounted on each of the massage node bases 16 and at least partially protrudes through the top surface 14. The massage node 18 is mounted for rote movement in relation to the massage base 12. More specifically, the massage node 18 is mounted for repeated, massaging motion. A motor 20, connected to the massage node base 16, engages the massage node 18 in rote movement in relation to the massage base 12.

Figure 2:
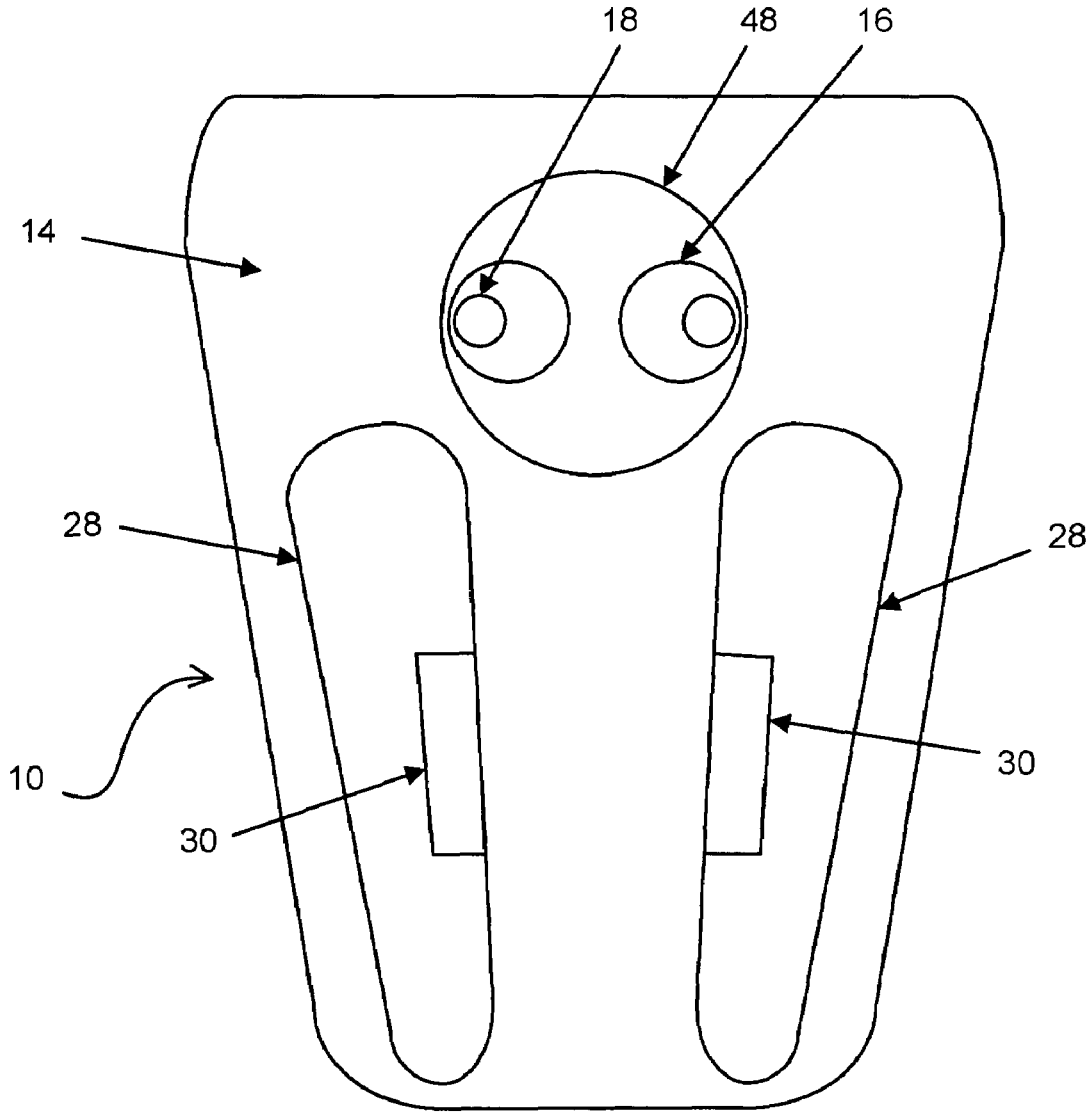
FIG. 2 is a top view of a massager in accordance with a first exemplary embodiment.

In the first exemplary embodiment, as shown in FIG. 2, the massage device 10 may be joined with at least one percussive massaging pad 28 mounted to the massage base 12 and/or at least one heat massaging plate 30 mounted to the massage base 12. The percussive massaging pad 28 provides a constant tapping or striking to the sole of the foot or other body part being massaged. Other massage apparatus, known to those with ordinary skill in the art, may similarly be provided on the massage device 10, along or beyond the periphery of the massage nodes 18 instead of or in addition to the percussive massaging pad 28 and the heat massaging plate 30. The other massage apparatus may include, but is not limited to, vibratory massaging pads, additional kneading nodes, and cold massage.

Many possible shapes and locations exist for the percussive massaging pad 28. The percussive massaging pad 28 may cover the areas of the top surface 14 not occupied by the massage nodes 18 or the heat massaging plate 30. In addition, the percussive massaging pad 28 may be shaped to receive two feet on the top surface 14. Alternatively, the percussive massaging pad 28 may be shaped in other ways recognizable to those having ordinary skill in the art. The heat massaging plate 30 may be sized to warm the entirety of each foot, may be sized to warm only the arches of each foot or may be sized in other manners known to those having ordinary skill in the art.

Figure 3:
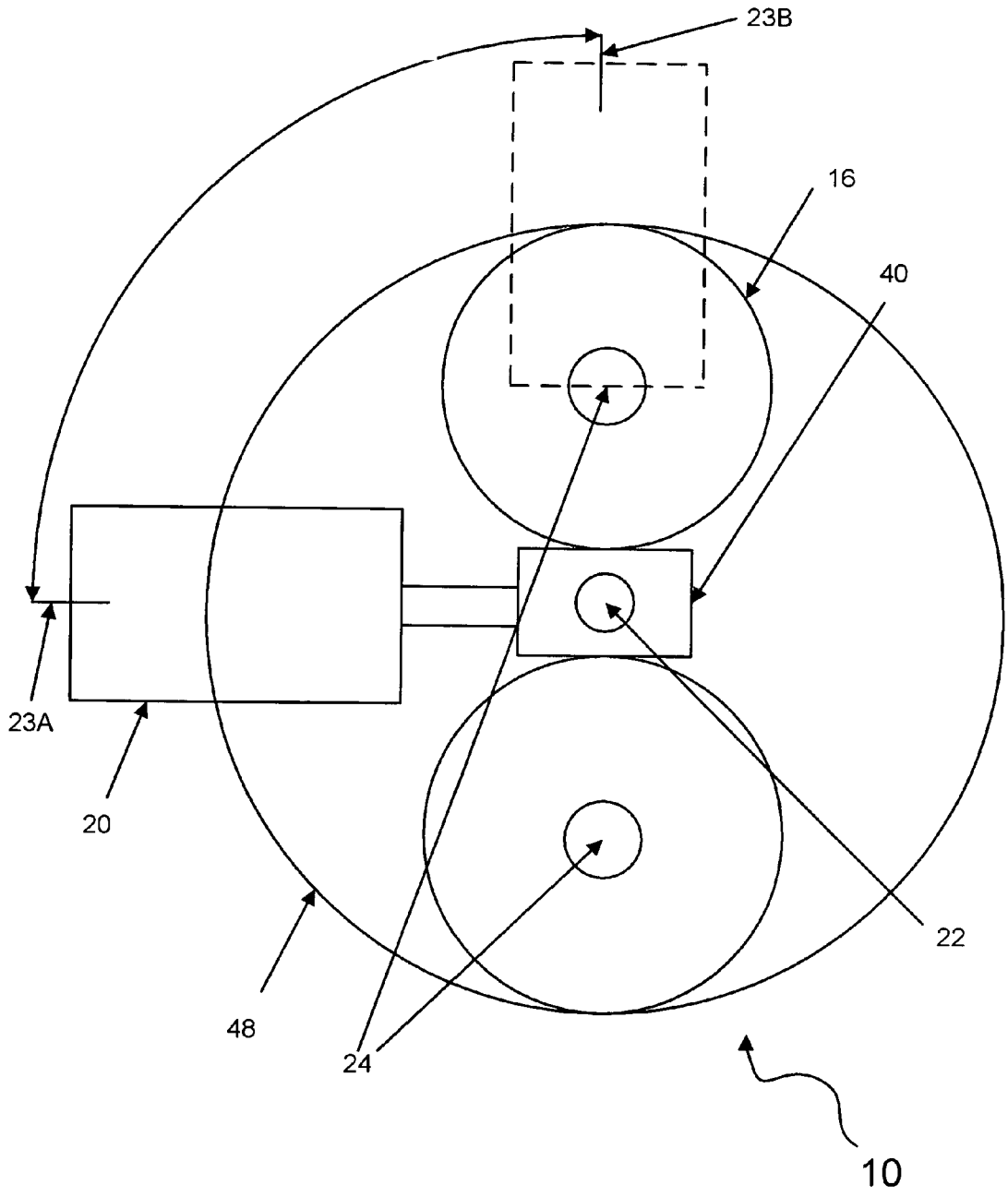
FIG. 3 is a top view of the internal components of the first exemplary embodiment of the massager shown in FIG. 1.

FIG. 1 is a cross-sectional side view of the first exemplary embodiment of the massager. FIG. 3 is a top view of the internal components of the first exemplary embodiment of the massager shown in FIG. 1. The massage node bases 16 rotatable about a first axis 22. In this embodiment, the massage node base 16 can be rotated along a rotational track 48, as shown in FIG. 3, between a first position 23*a* and a second position 23*b*. Rotational angle of the rotational track 48 may be limited due to the motor 20 rotating with most of the massage device 10 and space and wiring limitations that may impede rotation of the motor 20. As an example, the rotational track 48 may have a limited rotational angle of at least ninety degrees. It should be noted, however, that this embodiment may be modified to allow rotation along the rotational track 48 more or less than ninety degrees. The massage node base 16 may be limited to operating in either the first position 23*a* or the second position 23*b*, or it may be designed to operate in any position along the rotational track 48. In one alternative embodiment, the massage node bases 16 may be designed to slide linearly, along a linear track, in relation to the massage base 12. Many variations and modifications may be made to the above-described motility of the massage node bases 16 without departing substantially from the spirit and principles of the invention.

In the first exemplary embodiment, rotation of the massage node bases 16 is provided about the first axis 22 through the interaction of the rotational track 48 and a rotational surface 46. The rotational surface 46 includes all of the elements coplanar with and within the circumference of the rotational track 48. The rotational surface 46 is rotatably connected to the rotational track 48. Several parts within the massage device 10 are also rotated as the rotational surface 46 is rotated along the rotational track 48. A set of gears 40, which control the rotation of the massage nodes 18 about second axes 24, rotate in step with the rotational surface 46. The motor 20 and the shaft 44, which at least controls the rotation of the massage nodes 18 about the second axes 24, as further described herein, are rotated in step with the rotational surface 46 in the first exemplary embodiment. The massage node base 16 is a sub-element of the rotational surface 46 and rotates about the first axis 22 therewith. The massage nodes 18 are sub-elements of the rotational surface 46 and rotate about the first axis 22 therewith. The rotational surface 46 is substantially circular, allowing it to rotate in communication with the rotational track 48 at the top surface 14 of the massage base 12 while maintaining integrity of the top surface 14. The motile massage node bases 16 may be either manually moved about within the massage base 12 or may be moved within the massage base 12 by a motorized mechanism. One having ordinary skill in the art would understand how to provide such a motorized mechanism within the framework of the presently disclosed massage device 10.

In the first exemplary embodiment, the massage nodes 18 are configured to knead or rub body parts in rote movement. Rotating the massage node bases 16 about secondary axes 24 creates the rote movement of the massage nodes 18. In the first exemplary embodiment, the motor 20 is in communication with the shaft 44; the shaft is in communication with the gears 40; and the gears 40 are in communication with the massage node bases 16. When initiated, the motor 20 causes the shaft 44 to rotate. Rotation of the shaft 44 causes each of the gears 40 to rotate, which eventually cause each of the massage node bases 16 to rotate about the second axes 24. The rotation of the massage node bases 16, rotates the massage nodes 18 about secondary axes 24, which, when pressed against body parts, results in kneading body parts. Other rote movements of the massage nodes 18, include, but are not limited to, percussive movement and vibratory movement.

As is depicted in FIG. 1, the massage nodes 18 protrude through the top surface 14 with an egg-like rounded face for massaging body parts. The massage device 10 may feature a plurality of massage nodes 18 on a single massage node base 16 and it may feature a plurality of massage nodes 18 on a plurality of massage node bases 16. In the first exemplary embodiment, there are two massage node bases 16, each featuring a single massage node 18. The massage node bases 16 may be designed to rotate about secondary axes 24 such that one massage node base 16 rotates in a clockwise direction while the other massage node base 16 rotates in a counterclockwise direction. The disclosed motion of the two massage node bases 16 results in the two massage nodes 18 rotating in opposite directions. The two massage nodes 18 rotating in opposite directions creates a shiatsu massage effect for the body part being massaged. Many variations and modifications may be made to the above-described configuration of massage nodes 18 and massage node bases 16 for the massage device 10 without departing substantially from the spirit and principles of the massage device 10.

As shown in the first exemplary embodiment, the massage device 10 may include a massage node membrane 26. The massage node membrane 26 at least partially blankets the massage nodes 18 and attaches to the top surface 14 of the massage base 12. Two purposes of the massage node membrane 26 include sealing an opening in the top surface 14 protecting an interior of the massage base 12 from various dirt and debris and protecting a body parts of a user from moving mechanical parts in the massage base 12. The massage node membrane 26 is preferably durable enough to minimize wear from the kneading, but flexible enough to translate the kneading action from the massage nodes 18 to the body parts being massaged. The massage node membrane 26 may be made of a cloth or elastomeric substance. In the first exemplary embodiment, the massage node membrane 26 rotates with the other parts of the massage device 10 about the first axis when the massage node bases 16 are rotated about the first axis 22. It should be noted, however, that the massage node membrane 26 could easily be designed to attach to a non-rotating portion of the top surface 14.

Figure 4:
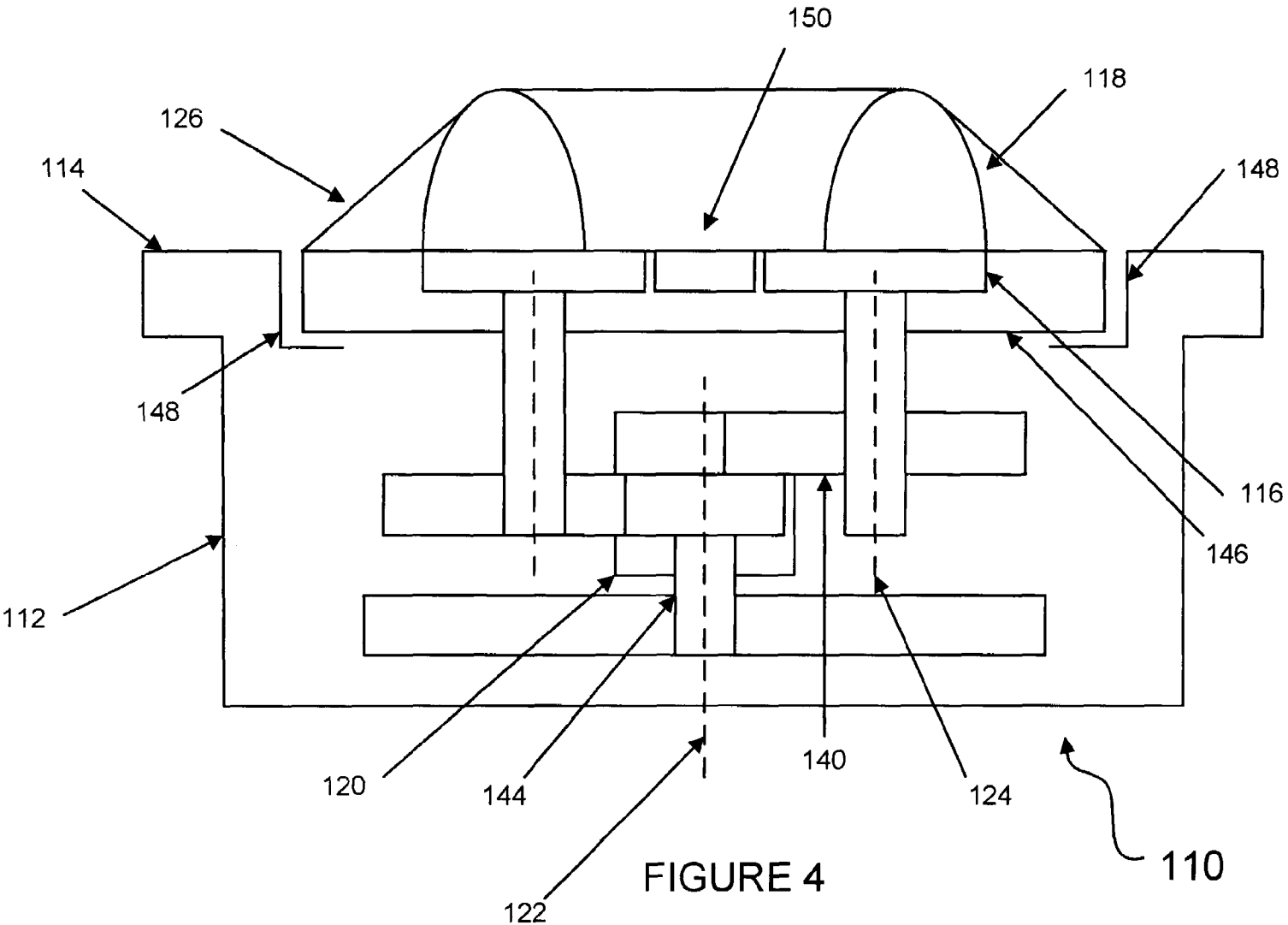
FIG. 4 is a cross-sectional side view of a second exemplary embodiment of the massager.
Figure 5:
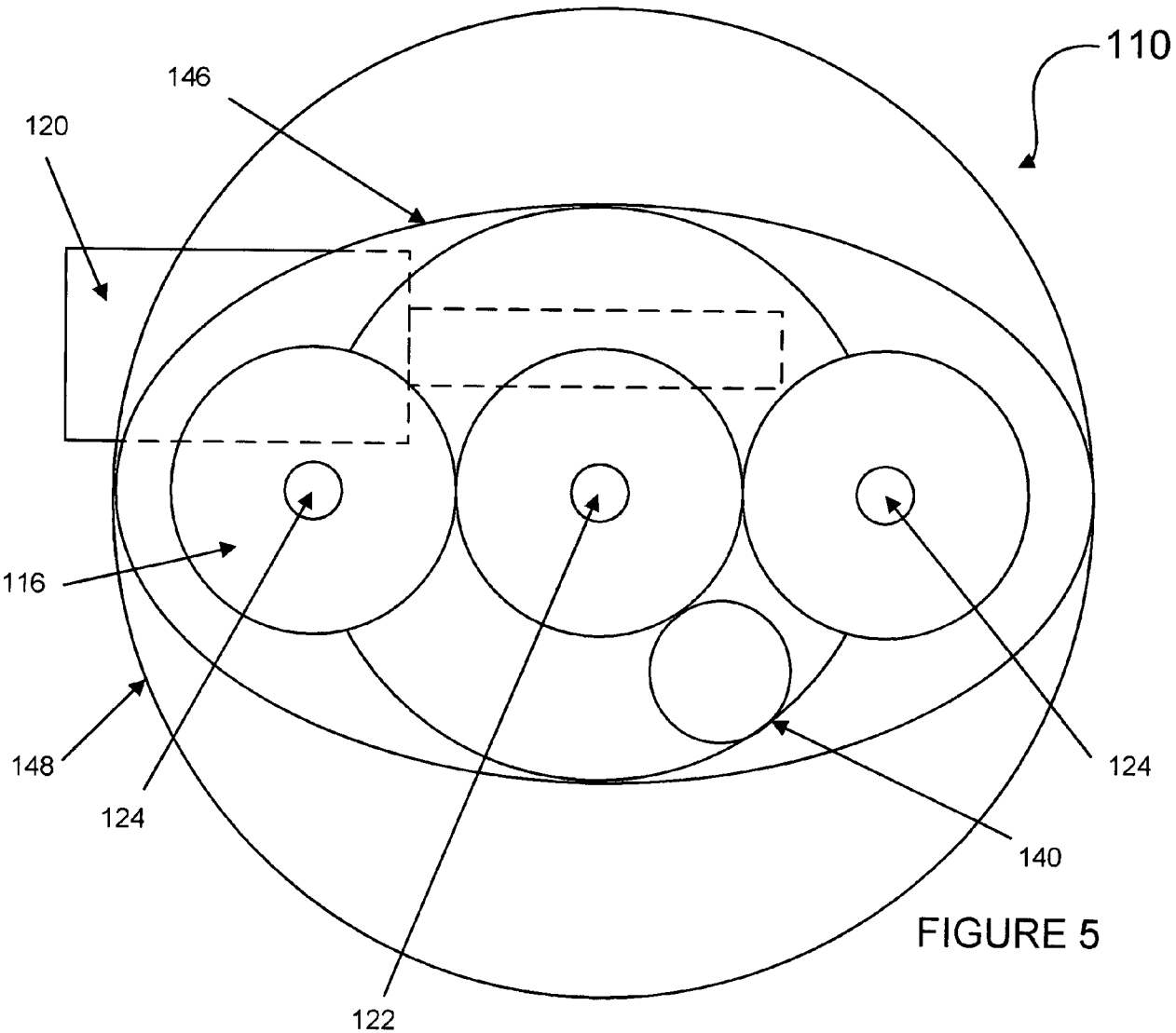
FIG. 5 is a cross-sectional top view of the second exemplary embodiment of the massager shown in FIG. 4.

FIG. 4 and FIG. 5 depict a second exemplary embodiment of the massage device 110. The second exemplary embodiment contains a massage device 110, which includes a massage base 112 having a top surface 114. The massage base 112 contains at least one massage node base 116 wherein the massage node base 116 is motile in relation to the massage base 112. At least one massage node 118 is mounted on each of the massage node bases 116 and at least partially protrudes through the top surface 114. The massage node 118 is mounted for rote movement in relation to the massage base 112. A motor 120, connected to the massage node base 116 through the shaft 144 and gears 140, engages the massage node 118 in rote movement in relation to the base 112.

One of the features of the massage device 110 captured in the second exemplary embodiment is having the massage node bases 116 rotatable about a first axis 122 to achieve motility. In this embodiment, the massage node base 116 can be rotated a full three hundred sixty degrees about the first axis 122. A set of gears 140, enable rotation of the massage node bases 116 about the first axis 122. The massage node bases 116 and massage nodes 118 are all rotated within the base 112 on shaft 144 and along rotational track 148, around the first axis 122. An island 150, which rests substantially in the middle of the top surface 114, remains immobile when the massage node bases 116 and the massage nodes 118 are rotated about the first axis 122. In this second exemplary embodiment, when the massage node bases 116 are rotated about first axis 122, the motor 120 and the shaft 144 remain stationary. The motile massage node bases 116 may be either manually moved about within the massage base 112 or may be moved within the massage base 112 by a motorized mechanism. One having ordinary skill in the art would understand how to provide such a motorized mechanism within the framework of the presently disclosed massage device 110.

The massage device 110 may have a plurality of massage node bases 116, as shown in the second exemplary embodiment. The separate massage node bases 116 may be rigidly interconnected and immotile in relation to each other. The immotility of the massage node bases 116 requires that when one of the massage node bases 116 is moved relative to the base 112, all of the massage node bases 116 are moved relative to the base 112. If the massage node bases 116 in FIG. 5 are immotile in relation to each other, then when one massage node base 116 is rotated around the first axis 122, the other massage node base 116 rotates around the first axis 122 in the same axial direction. Alternatively, the massage node bases 116 may be freely connected to the shaft 144 independent of each other, allowing one massage node base 116 to be rotated around the first axis 122 while the other massage node base 116 remains stationary.

In the second exemplary embodiment, the massage nodes 118 are configured to knead or rub body parts in rote movement. Rotating the massage node bases 116 about secondary axes 124 creates the rote movement of the massage nodes 118. The rotation of the massage node bases 116, rotates the massage nodes 118 about secondary axes 124, which results in kneading body parts. Other rote movements of the massage nodes 118, include, but are not limited to, percussive movement and vibratory movement.

One of the differences between the first exemplary embodiment and the second exemplary embodiment is space consumption. In the first exemplary embodiment, the motor 20 and other parts of the massage device 10 are rotated, which requires an amount of clearance within the massage base 12 to permit rotation. In the second exemplary embodiment, by allowing the motor 120 and other parts of the massage device 110 to remain stationary, the amount of clearance space required within the massage base 112 is reduced.

Figure 6:
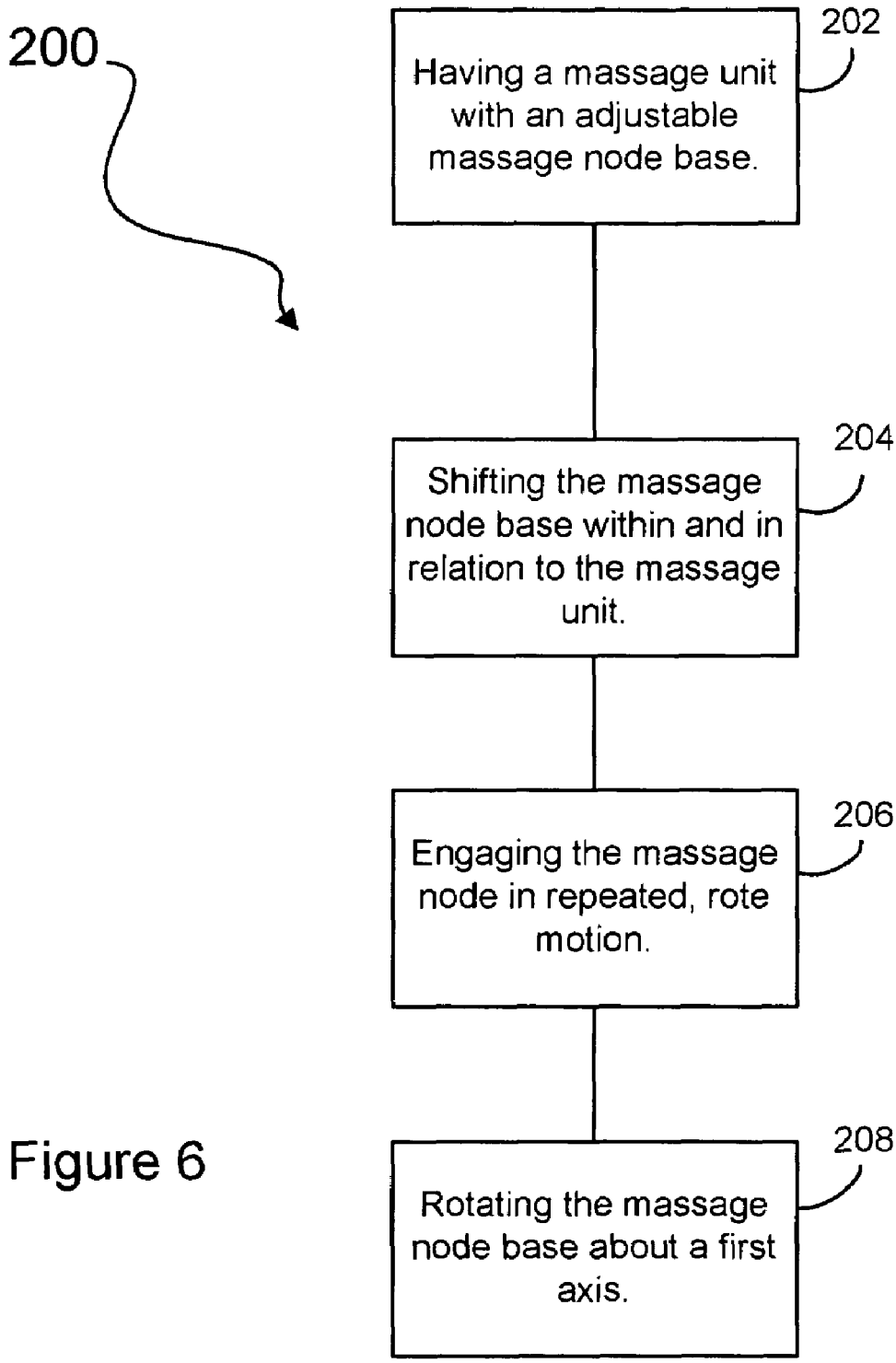
FIG. 6 is a flow diagram illustrating functions performed by the foot massager in accordance with the first embodiment of the invention.

FIG. 6 is a flowchart illustrating the architecture, functionality, and operation of a possible implementation of the massage device 10 of FIG. 1. In this regard, each block represents a module or segment, which comprises one or more executable instructions for implementing the specified function(s). It should also be noted that in some alternative implementations, the functions noted in the blocks may occur out of the order noted in the flow chart. For example, two blocks shown in succession may in fact be executed substantially concurrently or the blocks may sometimes be executed in the reverse order, depending upon the functionality involved, as will be further clarified hereinbelow.

Referring to FIG. 6, the present invention can be viewed as providing a method 200 of altering a massage node 18 layout on a massage device 10. The method 200 shown in FIG. 6 utilizes the first exemplary embodiment of the massage device 10 (block 202), as described above. The massage node base 16 is then shifted within and in relation to the massage base 12 (block 204). Shifting the massage node base 16 along the rotational track 48 allows a person using the massage device 10 to relocate the massage node base 16 and the massage nodes 18 thereon such that the person could slide the massage nodes 18 to the location on the massage device 10 where the massage nodes 18 can most effectively massage the feet of a person. The massage nodes 18 are then engaged in repeated rote motion (block 206) by the motor 20 to create a massaging motion for the feet of a person.

One of the prospective designs for the present method 200 involves the step of shifting the massage node base 16 (block 204) being accomplished by rotating the massage node base 16 about a first axis 22 (block 208). Another prospective design involves the massage node 18 being mounted for rote movement about a second axis 24, wherein the first axis 22 and the second axis 24 are non-collinear. Another alternative embodiment of the method 100 involves making the shifting of the massage node base 16 (block 204) a motorized act.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

We claim:

1. A foot massage device comprising:

a massage base having a top surface;

at least one massaging pad on the massage base, the at least one massaging pad being configured to receive at least a portion of at least one foot and being configured to massage a sole of the at least one foot;

at least one massage node base within the massage base and located beyond one end of the at least one massaging pad, wherein the at least one massage node base is rotatable in relation to the massage base about a first axis to a fixed position;

at least one massage node mounted on the at least one massage node base and at least partially protruding from the top surface, wherein the at least one massage node is mounted for rote movement in relation to the massage base about a secondary axis while the at least one massage node base is limited to the fixed position, the secondary axis being non-collinear and substantially parallel with the first axis; and at least one motor connected to the at least one massage node base whereby the motor enables rote movement of the at least one massage node in relation to the massage base.

2. The massage device of claim 1 wherein the rote movement, for which the at least one massage node is mounted, is rotational movement about the secondary axis.

3. The massage device of claim 1 comprising two massage node bases, each of the massage node bases having one massage node mounted thereon.

4. The massage device of claim 1 further comprising a massage node membrane at least partially blanketing the at least one massage node.

5. The massage device of claim 1 further comprising at least one heat massaging plate mounted to the at least one massaging pad on the massage base.

6. The massage device of claim 1 comprising a plurality of massage node bases, wherein the massage node bases are rigidly interconnected.

7. The massage device of claim 1 comprising a plurality of massage node base, wherein the at least one motor further comprises one motor for each of the massage node bases.

8. The massage device of claim 1 wherein the at least one motor moves with the at least one massage node base when the at least one massage node base rotates about the first axis.

9. The massage device of claim 1 wherein the at least one massage node comprises two massage nodes and a combined motion of the rote movement of the two massage nodes is a shiatsu motion.

10. A method of altering a massage node layout on a foot massaging device, said method comprising the steps of:

providing the foot massage device comprising:

a massage base with a top surface;

at least one massaging pad on the massage base, the at least one massaging pad being configured to receive at least a portion of at least one foot and being configured to massage a sole of the at least one foot;

at least one massage node base in the massage base and located beyond one end of the at least one massaging pad;

at least one massage node mounted on the at least one massage node base, the at least one massage node at least partially protruding from the top surface, wherein the at least one massage node is mounted for rote movement in relation to the massage base; and a motor connected to the at least one massage node base;

rotating the at least one massage node base about a first axis to a fixed position, within and in relation to the massage base;

positioning at least one foot on the massage device such that a portion of the at least one foot contacts the at least one massaging pad and a portion of the at least one foot contacts the at least one massage node; and engaging the at least one massage node in repeated rote motion about a second axis while the at least one massage node base is limited to the position, the secondary axis being non-collinear and substantially parallel with the first axis.

11. The method of claim 10 further comprising the steps of:

moving the at least one massage node in relation to the massage base before the step of rotating the at least one massage node base; and moving the at least one massage node again in relation to the massage base after the step of rotating the at least one massage node base.

12. A foot massage system comprising:

a massage base;

at least one massaging pad on the massage base, the at least one massaging pad being configured to receive at least a portion of at least one foot and being configured to massage a sole of the at least one foot;

a means for providing a kneading motion with the means being located within the massage base and beyond one end of the at least one massaging pad, for massaging a portion of the foot with a kneading motion about a secondary axis; and a means for rotating the kneading means about a first axis to a fixed position, the first axis being non-collinear and substantially parallel with the secondary axis, wherein the means for kneading is limited to operating in the fixed position, and the means for rotating the kneading means is within the massage base.

13. The massage system of claim 12 further comprising a means for power for powering the means for rotating the kneading means.

14. A foot massage device comprising:

a massage base having a top surface;

at least one massaging pad on the massage base, the at least one percussive massaging pad being configured to receive at least a portion of at least one foot and being configured to massage a sole of the at least one foot;

a planar rotational surface disposed within a rotational track on the top surface of the massage base and configured for rotation relative to the massage base about a first axis, the A planar rotational surface being located beyond one end of the at least one percussive massaging pad;

at least two massage node bases positioned on the planar rotational surface, wherein each of the at least two massage node bases are configured for rotation relative to the massage base about one of at least two secondary axes while the planar rotational surface remains stationary relative to the massage base, the at least two secondary axes being non-collinear with the first axis;

at least one massage node mounted on each of the at least two massage node bases and extending upwards from the at least two massage node bases; and a motor connected to the at least two massage node bases.

15. The massage device according to claim 14, wherein the rotational surface rotates along the rotational track.

16. The massage device according to claim 15, wherein the rotational surface and the at least two massage node bases are substantially coplanar.

* * * * *